US011239606B2

(12) United States Patent
Cabañero

(10) Patent No.: US 11,239,606 B2
(45) Date of Patent: Feb. 1, 2022

(54) ELECTRICAL CONNECTOR ASSEMBLY

(71) Applicant: Lear Corporation, Southfield, MI (US)

(72) Inventor: Albert Cabañero, Cebu (PH)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/822,289

(22) Filed: Mar. 18, 2020

(65) Prior Publication Data

US 2021/0296822 A1 Sep. 23, 2021

(51) Int. Cl.

| | |
|---|---|
| ***H01R 13/639*** | (2006.01) |
| ***H01R 13/502*** | (2006.01) |
| ***H01R 12/77*** | (2011.01) |
| ***H01R 13/422*** | (2006.01) |
| ***H01R 13/629*** | (2006.01) |

(52) U.S. Cl.

CPC ..... *H01R 13/639* (2013.01); *H01R 12/77* (2013.01); *H01R 13/4223* (2013.01); *H01R 13/502* (2013.01); *H01R 13/629* (2013.01)

(58) Field of Classification Search

CPC .... H01R 4/2407; H01R 4/2433; H01R 12/77; H01R 12/774; H01R 12/772; H01R 13/639; H01R 13/422; H01R 13/502

USPC ..... 439/409, 492

See application file for complete search history.

(56) References Cited

U.S. PATENT DOCUMENTS 3,845,236 A 10/1974 Anderson
4,252,392 A * 2/1981 Whiteman, Jr. ..... H01R 12/88 439/267
4,509,809 A 4/1985 Wang
5,785,548 A * 7/1998 Capper ..... H01R 4/2433 439/341
6,027,009 A * 2/2000 Shinchi ..... H01R 4/024 228/111.5
6,682,363 B1 * 1/2004 Chang ..... H01R 24/64 439/409
6,830,489 B2 12/2004 Aoyama
7,144,256 B2 * 12/2006 Pabst ..... H01R 12/79 439/67
7,695,295 B2 * 4/2010 Hanyu ..... H01R 12/774 439/153
7,794,267 B2 * 9/2010 Daily ..... H01R 12/721 439/409

(Continued)

FOREIGN PATENT DOCUMENTS

GB 1600067 A * 10/1981 ..... H01R 24/28
JP H076801 1/1995

*Primary Examiner* — Marcus E Harcum
(74) *Attorney, Agent, or Firm* — MacMillan, Sobanski & Todd, LLC

(57) ABSTRACT

A combined assembly of an electrically conductive structure and an electrical connector assembly includes an electrically conductive structure and an electrically connector assembly. The electrically connector assembly includes a housing defining an interior space and a locking arm. The interior space of the housing receives the electrically conductive structure. The locking arm is supported for movement relative to the housing from an unlocked position, wherein the locking arm does not retain the electrically conductive structure within the interior space, to a locked position, wherein the locking arm retains the electrically conductive structure within the interior space. An electrical contact is disposed within the housing and engages the electrically conductive structure retained within the interior space.

14 Claims, 5 Drawing Sheets

(56) References Cited

U.S. PATENT DOCUMENTS

| | | | | |
|---|---|---|---|---|
| 8,062,058 | B1 | 11/2011 | Moldoch et al. | |
| 9,590,335 | B1 * | 3/2017 | Ashibu | H01R 12/88 |
| 10,186,789 | B1 * | 1/2019 | Rust | H02G 15/076 |
| 2001/0046804 | A1 * | 11/2001 | Fuchs | H01R 12/88 439/495 |
| 2003/0119353 | A1 * | 6/2003 | Hotea | H01R 12/777 439/492 |
| 2006/0271136 | A1 | 11/2006 | Wojciechowicz | |
| 2007/0123091 | A1 * | 5/2007 | Swedberg | H01R 4/4836 439/409 |
| 2008/0207035 | A1 * | 8/2008 | Jahn | H01R 12/52 439/329 |
| 2010/0068917 | A1 * | 3/2010 | Dennes | H04Q 1/144 439/409 |
| 2010/0075541 | A1 * | 3/2010 | Niitsu | H01R 12/78 439/658 |
| 2013/0109212 | A1 * | 5/2013 | Ohyama | H01R 13/5205 439/272 |
| 2014/0349513 | A1 * | 11/2014 | Mathews | H01R 13/64 439/470 |
| 2016/0329647 | A1 * | 11/2016 | Okura | H01B 7/08 |
| 2016/0380373 | A1 * | 12/2016 | Tojo | H01R 12/721 439/499 |
| 2017/0331206 | A1 * | 11/2017 | Manba | H01R 12/61 |
| 2018/0269599 | A1 * | 9/2018 | Garcia Pichardo | H01R 4/2407 |
| 2020/0251842 | A1 * | 8/2020 | Takane | H01R 12/79 |

* cited by examiner

ELECTRICAL CONNECTOR ASSEMBLY

BACKGROUND OF THE INVENTION

This invention relates in general to electrical connector assemblies that facilitate mechanical and electrical connections between two electrically conductive structures. In particular, this invention relates to an improved structure for such an electrical connector assembly that can quickly and easily be secured to an electrically conductive structure, such as a flat flexible cable having multiple electrically conductive traces, without the use of specialized tools and/or methods.

Many electrical systems are known in the art that include one or more electrically operated devices. For example, most automobiles and other vehicles include a variety of electrically operated devices that can be selectively operated for the comfort and convenience of a driver or an occupant. Typically, each of these electrically operated devices is connected to a source of electrical energy (and/or other components of the electrical system) by one or more electrical conductors. In many instances, electrical connector assemblies are provided for facilitating the installation, service, and removal of these electrically operated devices to and from the electrical system.

A typical electrical connector assembly includes an outer housing (which is usually formed from an electrically non-conductive material) and an inner electrical terminal (which is usually formed from an electrically conductive material) that is supported within the housing. The housing usually has first and second openings extending therethrough, and the electrical terminal is supported within the housing adjacent to those first and second openings. The first opening facilitates the passage of an electrical conductor through the housing into engagement with the electrical terminal supported therein. The second opening facilitates the passage of a portion of a mating electrical terminal assembly through the housing into engagement with the electrical terminal.

In the past, the connection of the electrical conductor to the electrical terminal supported within the housing of the electrical connector assembly has been accomplished using a variety of specialized tools and/or specialized methods. Although effective, it has been found that the use of such known specialized tools and/or methods are relatively time-consuming and complicated. Thus, it would be desirable to provide an improved structure for an electrical connector assembly that can quickly and easily be secured to an electrically conductive structure, such as a flat flexible cable having multiple electrically conductive traces, without the use of specialized tools and/or methods.

SUMMARY OF THE INVENTION

This invention relates to an improved structure for an electrical connector assembly that can quickly and easily be secured to an electrically conductive structure, such as a flat flexible cable having multiple electrically conductive traces, without the use of specialized tools and/or methods. The electrically connector assembly includes a housing defining an interior space and a locking arm. The interior space of the housing receives the electrically conductive structure. The locking arm is supported for movement relative to the housing from an unlocked position, wherein the locking arm does not retain the electrically conductive structure within the interior space, to a locked position, wherein the locking arm retains the electrically conductive structure within the interior space. An electrical contact is disposed within the housing and engages the electrically conductive structure retained within the interior space.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
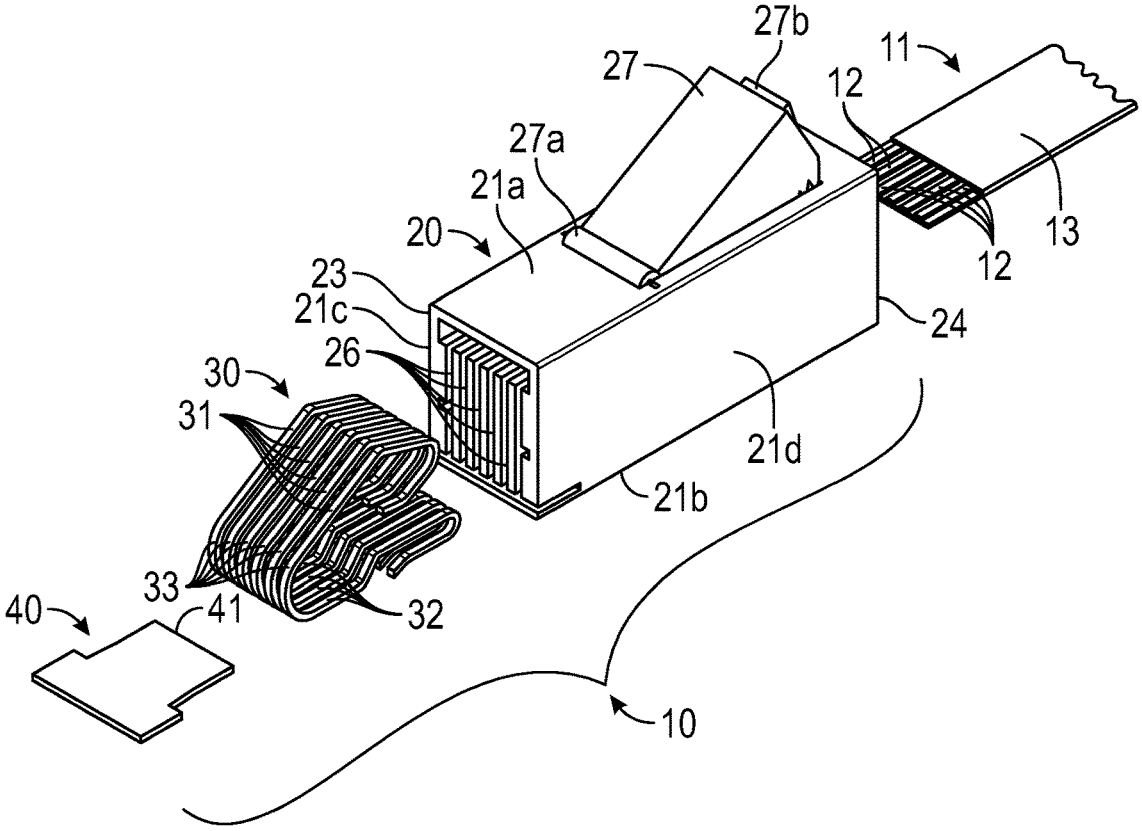
FIG. 1 is an exploded perspective view of an electrical connector assembly in accordance with this invention and an electrically conductive structure, shown prior to assembly.
Figure 2:
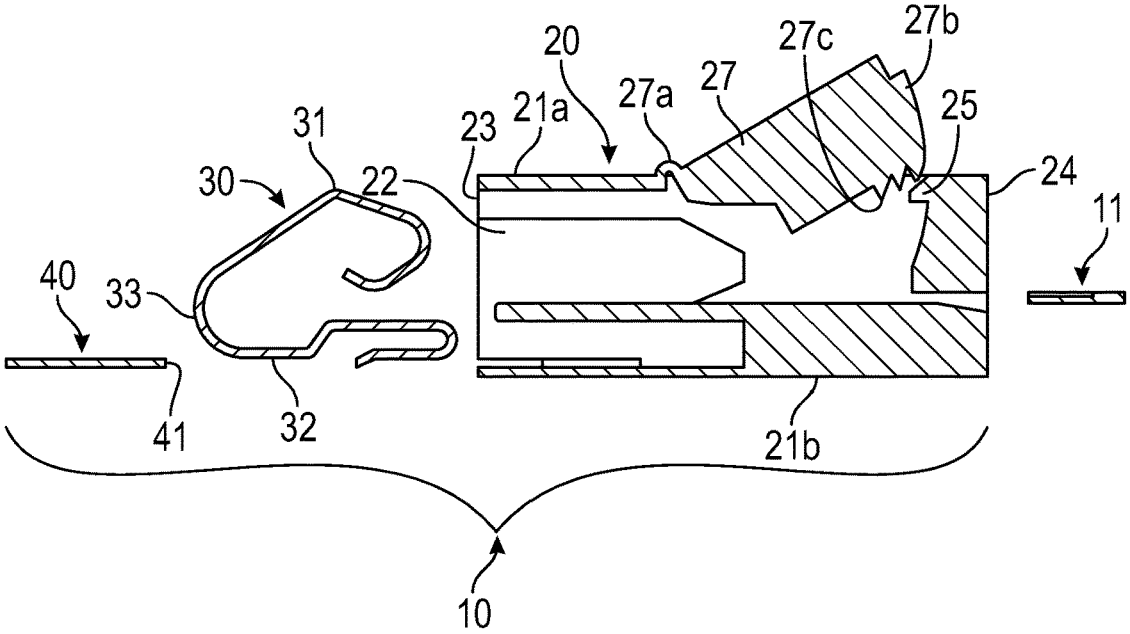
FIG. 2 is a side sectional elevational view of the electrical connector assembly and the electrically conductive structure illustrated in FIG. 1.

Referring now to the drawings, there is illustrated in FIGS. 1 and 2 an electrical connector assembly, indicated generally at 10, in accordance with this invention and an electrically conductive structure, indicated generally at 11, shown prior to assembly. As will be explained in detail below, the electrical connector assembly 10 is adapted to be connected to the electrically conductive structure 11 and, in turn, the electrically conductive structure 11 is adapted to be connected to an electrical device (not shown). However, the electrical connector assembly 10 of this invention may be used in any desired environment for any desired purpose.

The illustrated electrically conductive structure 11 is a flat flexible conductor 11 that is conventional in the art and includes a plurality (six in the illustrated embodiment) of electrically conductive traces 12 that are surrounded by an outer electrically non-conductive insulator 13. However, the flat flexible conductor 11 may include a greater or lesser number of such electrically conductive traces 12. For a reason that will become apparent below, a portion of the electrically non-conductive insulator 13 is removed adjacent to an end of the flat flexible conductor 11 so as to expose the electrically conductive traces 12. The illustrated flat flexible conductor 11 is intended to be representative of any conventional type of electrical conductor and, thus, forms no part of this invention.

The electrical connector assembly 10 includes a housing, indicated generally at 20. The housing 20 is preferably formed from an electrically non-conductive material, such as plastic. However, the housing 20 may be formed from any desired material. The housing 20 includes a body 21 having an upper panel 21*a*, a lower panel 21*b*, a left panel 21*c*, and a right panel 21*d* that together define an interior space 22. The interior space 22 extends from a first longitudinal end 23 of the body 21 to a second longitudinal end 24 of the body 21. A first portion of the interior space 22 is located adjacent to the first longitudinal end 23 of the body 21, while a second portion of the interior space 22 is located adjacent to the second longitudinal end 24 of the body 21. In the illustrated embodiment, the first portion of the interior space 22 is relatively large in size in comparison with the second portion of the interior space 22, although such is not required. A first locking member 25 is formed integrally with or otherwise provided on the body 21 and extends into the interior space 22. The purpose for the first locking member 25 will be explained below.

A plurality of dividers 26 is provided within the first portion of the interior space of the body 21, adjacent to the first longitudinal end 23 thereof. In the illustrated embodiment, five of such dividers 26 are formed integrally with the body 21 of the housing 20. Together with the left panel 21*c* and the right panel 21*d*, the dividers 26 separate the first portion of the interior space 22 of the body 21 of the housing 20 into six adjacent and parallel slots. As will be explained in detail below, the number of such slots provided in the body 21 of the housing 20 is preferably the same as the number of electrically conductive traces 12 provided on the flat flexible conductor 11. However, a greater or lesser number of such dividers 26 may be provided to separate the first portion of the interior space 22 of the body 21 of the housing 20 into a greater or lesser number of such slots. The purposes for the dividers 26 and the slots defined thereby will be explained in detail below.

A locking arm 27 is also provided on the body 21 of the housing 20. In the illustrated embodiment, the locking arm 27 is formed integrally with a living hinge 27*a* that is also formed integrally with the body 21 of the housing 20. Thus, the illustrated locking arm 27 is supported on the body 21 of the housing 20 for pivoting movement relative thereto between an unlocked position (illustrated in FIGS. 1 through 8) and a locked position (illustrated in FIGS. 9 and 10). However, the locking arm 27 may be supported or otherwise provided on the body 21 of the housing 20 in any desired manner. Additionally, the illustrated locking arm 27 has both a second locking member 27*b* and a retaining structure 27*c* provided thereon, although such is not required. In the illustrated embodiment, the retaining structure 27*c* is a plurality of serrations, although such is not required. The purposes for the locking arm 27, the second locking member 27*b*, and the retaining structure 27*c* will also be explained in detail below.

The electrical connector assembly 10 also includes one or more electrical contacts, each indicated generally at 30. Preferably, the number of such electrical contacts 30 is the same as the number of slots provided in the body 21 of the housing 20 (and, as mentioned above, the number of electrically conductive traces 12 provided on the flat flexible conductor 11). Thus, in the illustrated embodiment, six of the electrical contacts 30 are provided. However, a greater or lesser number of such electrical contacts 30 may be provided. As best shown in FIG. 2, each of the electrical contacts 30 includes a first contact portion 31 and a second contact portion 32 that are connected by an intermediate contact portion 33. The purposes for the electrical contacts 30 will be explained in detail below.

Lastly, the electrical connector assembly 10 includes a contact retainer, indicated generally at 40, having an inner end 41. In the illustrated embodiment, the contact retainer 40 is generally flat and planar in shape. However, the contact retainer 40 may have any desired shape. The purposes for the retainer 40 and its inner end 41 will also be explained below.

Figure 3:
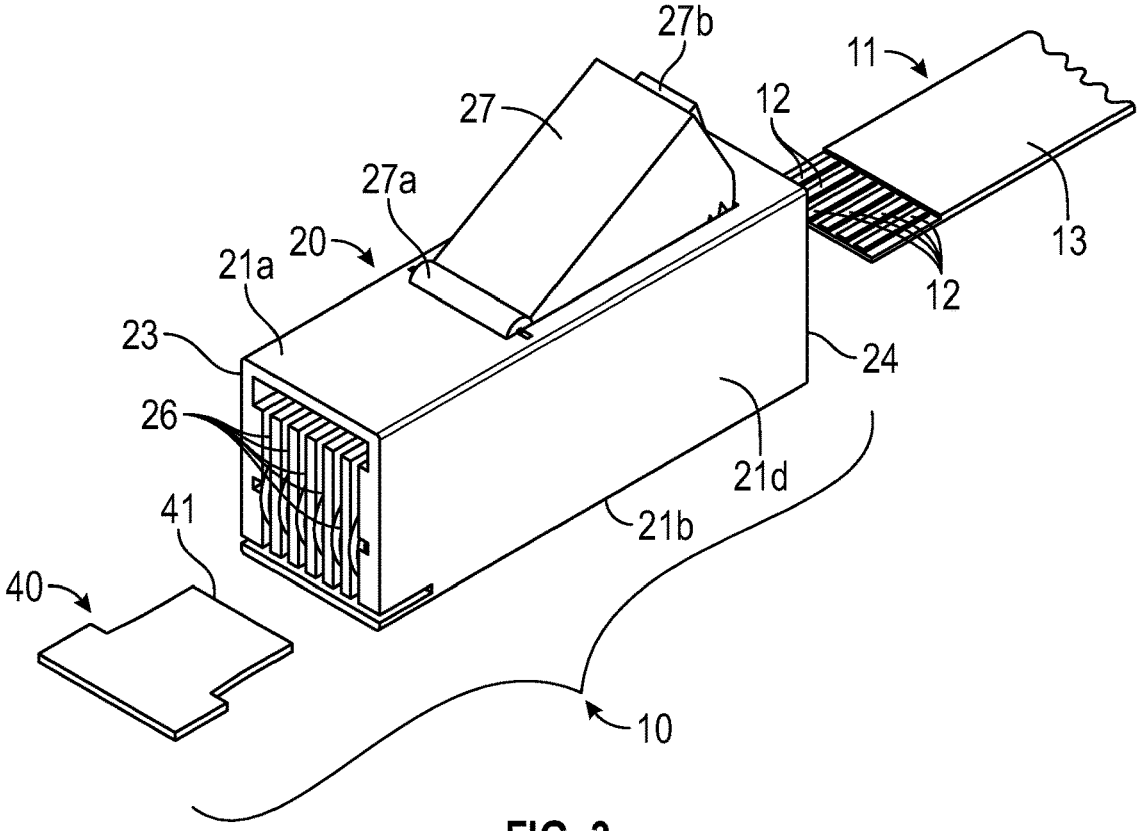
FIG. 3 is an exploded perspective view similar to FIG. 1 showing the electrical connector assembly in a first stage of assembly.
Figure 4:
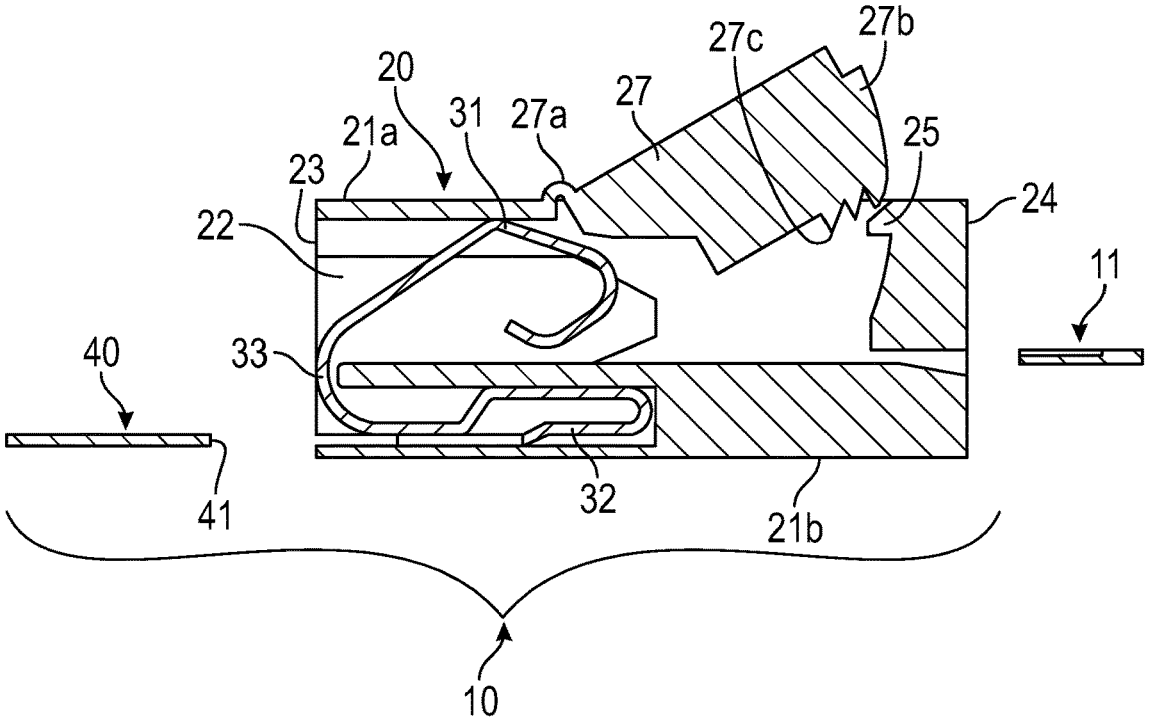
FIG. 4 is a side sectional elevational view of the electrical connector assembly and the electrically conductive structure illustrated in FIG. 3.

A method of assembling the electrical connector assembly 10 of this invention will now be described with reference to FIGS. 1 through 10. Initially, as shown in FIGS. 1 and 2, one of the electrical connectors 30 is longitudinally aligned with a corresponding one of the slots provided in the interior space 22 of the body 21 of the housing 20. Then, as shown in FIGS. 3 and 4, the electrical connector 30 is inserted longitudinally into the slot provided in the body 21 of the housing 20. Preferably, a distance defined by the outer surfaces of the first contact portion 31 and the second contact portion 32 of the electrical contact 30 is greater than a distance defined between the inner surfaces of the upper panel 21*a* and the lower panel 21*b* of the body 21 of the housing 20. As a result, when the electrical connector 30 is inserted into the slot provided in the body 21 of the housing 20, the first contact portion 31 and the second contact portion 32 of the electrical contact 30 are flexed inwardly toward one another. Most of this flexing is accommodated by deformation of the intermediate contact portion 33 of the electrical contact 30, although such is not required.

In any event, the outer surface of the first contact portion 31 of the electrical contact 30 frictionally engages the inner surface of the upper panel 21*a* of the body 21 of the housing 20, and the outer surface of the second contact portion 32 of the electrical contact 30 frictionally engages the inner surface of the lower panel 21*b* of the body 21 of the housing 20. Though not required, such frictional engagement is desirable because the electrical contact 30 is frictionally retained within the slot provided in the body 21 of the housing 20 during the remainder of the assembly process. The other electrical contacts 30 can be inserted within the respective slots in the body 21 of the housing 20 in a similar manner.

Figure 5:
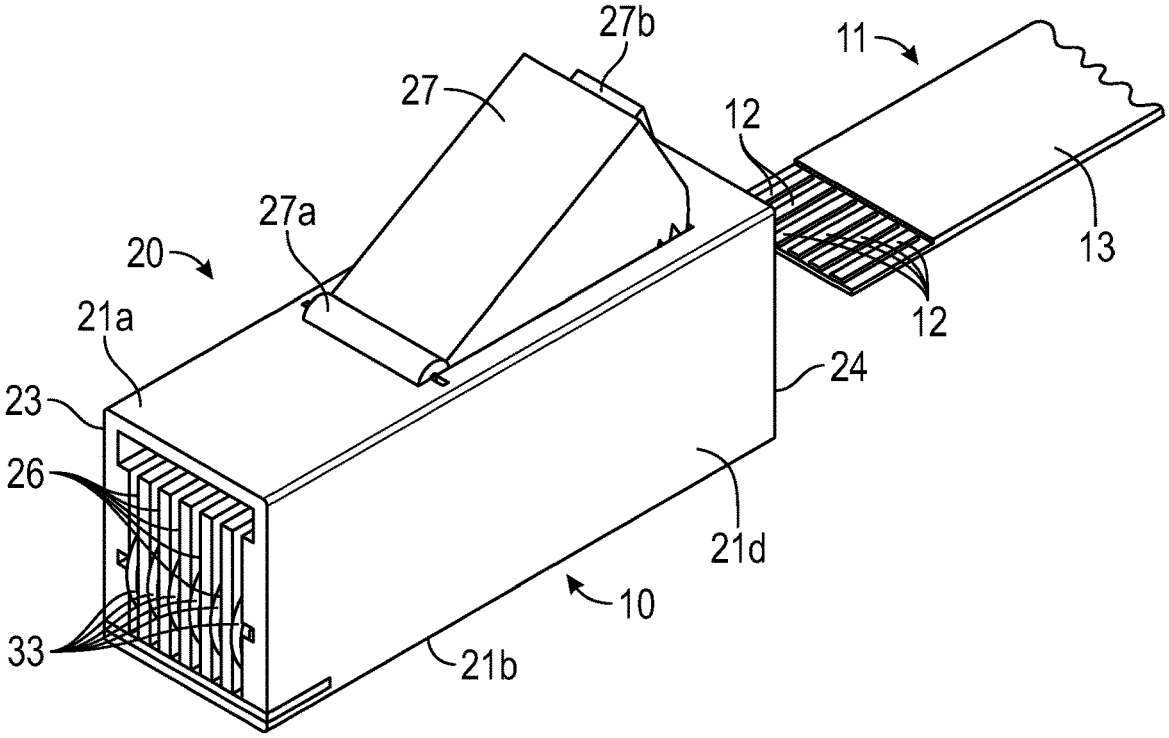
FIG. 5 is an exploded perspective view similar to FIG. 3 showing the electrical connector assembly in a second stage of assembly.
Figure 6:
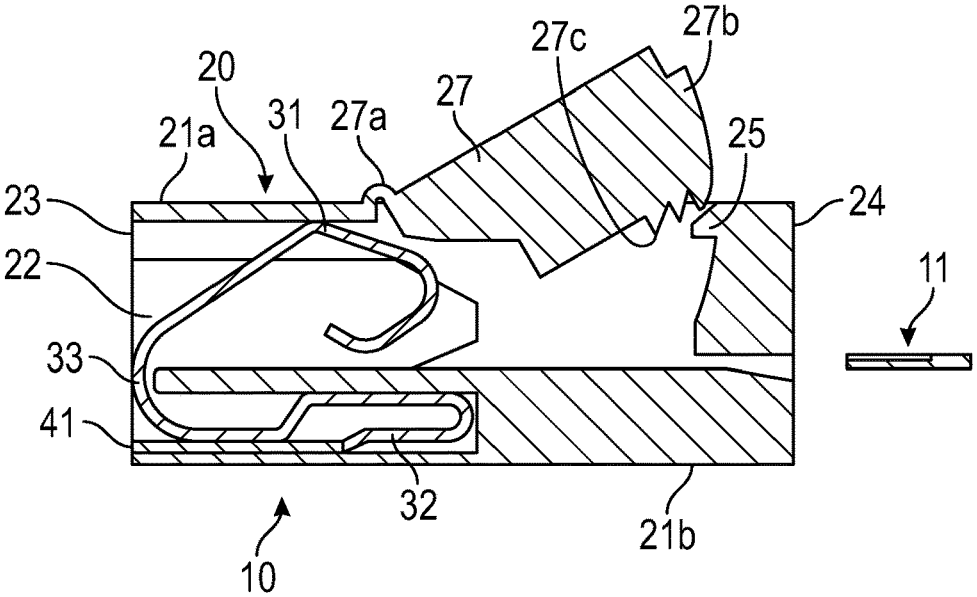
FIG. 6 is a side sectional elevational view of the electrical connector assembly and the electrically conductive structure illustrated in FIG. 5.

After all of the electrical contacts 30 have been inserted within the respective slots in the body 21 of the housing 20, the retainer 40 is inserted within the interior space 22 of the body 21 of the housing 20, as shown in FIGS. 5 and 6. In the illustrated embodiment, the retainer 40 is inserted within the interior space 22 adjacent to the lower panel 21*b* of the body 21 of the housing 20. However, the retainer 40 may be inserted within any desired portion of the inner space 22 of the body 21 of the housing 20. Preferably, when so inserted, the retainer 40 is positively connected to the body 21 of the housing 20 so as to prevent the inadvertent removal thereof. To accomplish this, a positive locking mechanism (not shown) may be provided on either or both of the retainer 40 and the body 21 of the housing 20. Alternatively, the retainer 40 may merely frictionally engage the lower panel 21*b* (or other portion) of the body 21 of the housing 20 for this purpose.

As best shown in FIG. 6, when the retainer 40 has been inserted within the interior space 22 of the body 21 of the housing 20, the inner end 41 of the retainer 40 abuts an end of the second contact portion 32 of each of the electrical contacts 30. Thus, the retainer 40 positively prevents each of the electrical contacts 30 from being withdrawn from the respective slots provided within the body 21 of the housing 20. This completes the initial manufacture of the electrical connector assembly 10.

Figure 7:
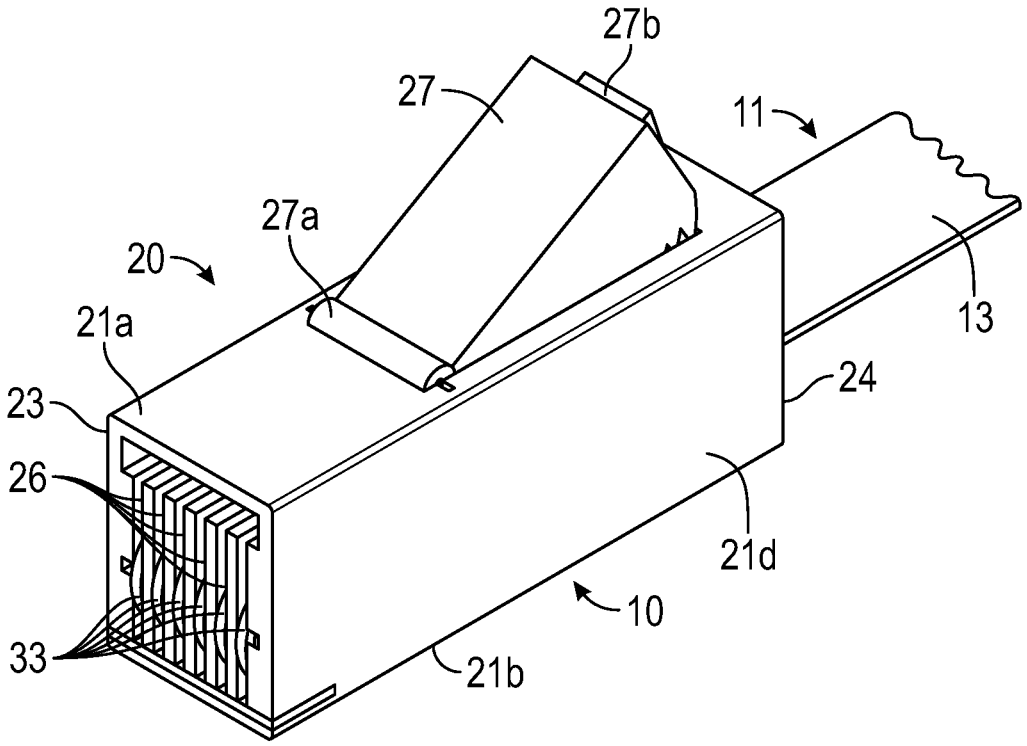
FIG. 7 is an exploded perspective view similar to FIG. 5 showing the electrical connector assembly in a final stage of assembly.
Figure 8:
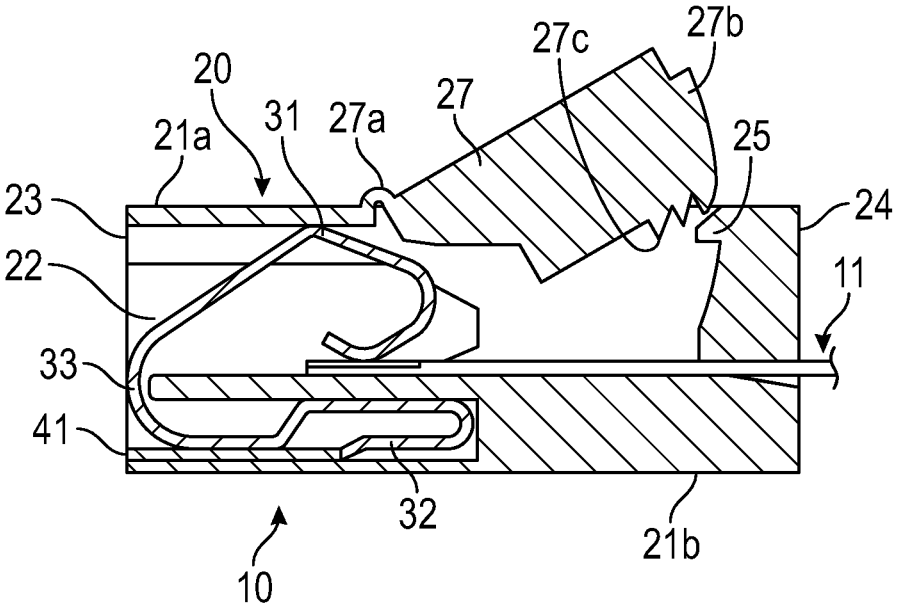
FIG. 8 is a side sectional elevational view of the electrical connector assembly and the electrically conductive structure illustrated in FIG. 7.

Next, as shown in FIGS. 7 and 8, the end of the flat flexible conductor 11 is inserted into the interior space 22 of the body 21 of the housing 20 from the second longitudinal end 24 thereof. As mentioned above, the illustrated flat flexible conductor 11 has six electrical traces 12 provided thereon, and a portion of the non-conductive insulator 13 adjacent to the end thereof is removed to expose the electrically conductive traces 12. As also mentioned above, the electrical traces 12 provided on the flat flexible conductor 11 are longitudinally aligned with each of the slots defined in the interior space 22 of the body 21 of the housing 20. Consequently, when the end of the flat flexible conductor 11 is inserted into the interior space 22 of the body 21 of the housing 20, each of the electrical traces 12 provided on the flat flexible conductor 11 engages a respective one of the second contact portions 32 of the electrical contacts 30. Thus, an electrically conductive path is provided between each of the electrical traces 12 provided on the flat flexible conductor 11 and the associated electrical contacts 30.

Figure 9:
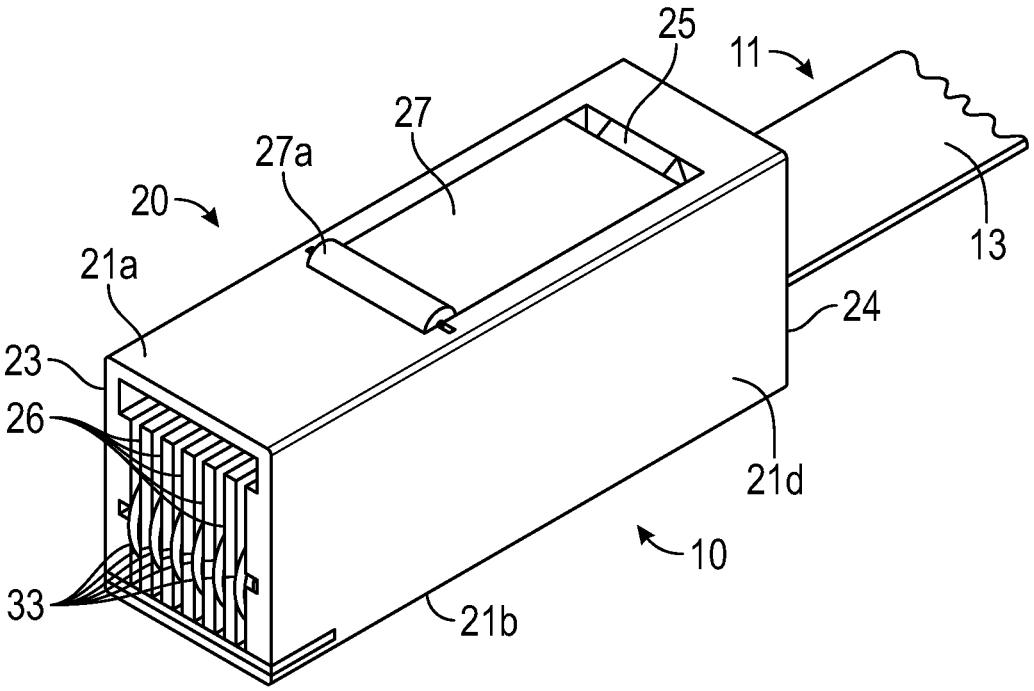
FIG. 9 is a perspective view similar to FIG. 7 showing the electrical connector assembly assembled with the electrically conductive structure.
Figure 10:
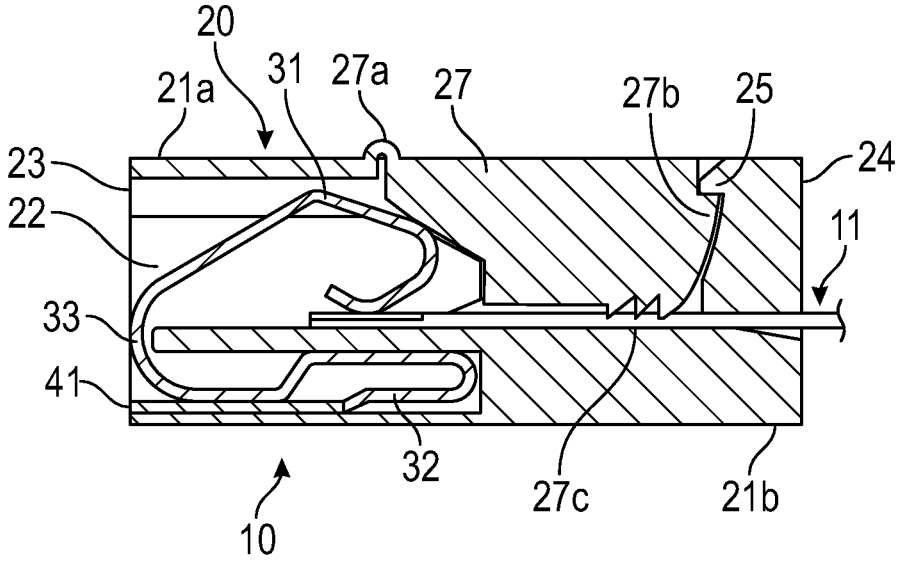
FIG. 10 is a side sectional elevational view of the assembled electrical connector assembly and electrically conductive structure illustrated in FIG. 9.

Lastly, as shown in FIGS. 9 and 10, the locking arm 27 is moved from the unlocked position (illustrated in FIGS. 1 through 8) to the locked position (illustrated in FIGS. 9 and 10). As discussed above, the living hinge 27*a* supports the locking arm 27 for such movement. When the locking arm 27 is moved to the locked position, the locking protrusion 27*a* provided on the locking arm 27 engages the locking protrusion 25 provided on the body 21 of the housing 20. As a result, the locking arm 27 is positively retained in the locked position. At the same time, the retaining structure 27*c* provided on the locking arm 27 engages a portion of the flat flexible conductor 11. As a result, the flat flexible conductor 11 is positively retained within interior space 22 of the body 21 of the housing 20.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector assembly comprising: a housing including a first locking member and having an interior space that is adapted to receive an electrically conductive structure; a locking arm formed integrally with a living hinge that is also formed integrally with the housing, the locking arm extending from the housing to an end including both a second locking member and a plurality of serrations, the locking arm being supported for movement relative to the housing from:

(1) an unlocked position, wherein the second locking member on the locking arm does not engage the first locking member on the housing such that the plurality of serrations on the locking arm is not adapted to retain the electrically conductive structure within the interior space, to (2) a locked position, wherein the second locking member on the locking arm engages the first locking member on the housing such that the plurality of serrations on the locking arm is adapted to retain the electrically conductive structure within the interior space; and an electrical contact disposed within the housing and adapted to engage the electrically conductive structure when retained within the interior space.

2. The electrical connector assembly defined in claim 1 wherein the locking arm is supported on the housing for movement from the unlocked position to the locked position.

3. The electrical connector assembly defined in claim 1 further including a contact retainer that is positively connected to the housing to prevent the electrical contact from being withdrawn from the housing.

4. The electrical connector assembly defined in claim 1 wherein the interior space of the housing is divided into a plurality of slots, and wherein respective electrical contacts are disposed within the plurality of slots that are adapted to engage the electrically conductive structures when retained within the interior space.

5. The electrical connector assembly defined in claim 4 further including a contact retainer that is positively connected to the housing to prevent each of the electrical contacts from being withdrawn from the housing.

6. The electrical connector assembly defined in claim 1 wherein the electrical contact includes a first contact portion and a second contact portion that are connected by an intermediate contact portion, and wherein each of the first contact portion and the second contact portion frictionally engage the housing.

7. A combined assembly of an electrically conductive structure and an electrical connector assembly comprising: a flat flexible conductor that is generally flat and elongated in shape and includes a plurality of generally flat and elongated electrically conductive traces; and an electrically connector assembly including; a housing including a first locking member and having an interior space of the housing that receives the flat flexible conductor; a locking arm extending from the housing to an end including both a second locking member and a retaining structure, the locking arm being supported for movement relative to the housing from (1) an unlocked position, wherein the second locking member on the locking arm does not engage the first locking member on the housing such that the retaining structure on the locking arm does not retain the flat flexible conductor within the interior space, to (2) a locked position, wherein the second locking member on the locking arm engages the first locking member on the housing such that the retaining structure on the locking arm and retains the flat flexible conductor within the interior space; and an electrical contact disposed within the housing and engaging the flat flexible conductor retained within the interior space.

8. The combined assembly defined in claim 7 wherein the locking arm is supported on the housing for movement from the unlocked position to the locked position.

9. The combined assembly defined in claim 7 wherein the locking arm is formed integrally with a living hinge that is also formed integrally with the housing.

10. The combined assembly defined in claim 7 wherein the retaining structure is a plurality of serrations.

11. The combined assembly defined in claim 7 further including a contact retainer that is positively connected to the housing to prevent the electrical contact from being withdrawn from the housing.

12. The combined assembly defined in claim 7 wherein the interior space of the housing is divided into a plurality of slots, and wherein respective electrical contacts are disposed within the plurality of slots and engages the electrically conductive structures when retained within the interior space.

13. The combined assembly defined in claim 12 further including a contact retainer that is positively connected to the housing to prevent each of the electrical contacts from being withdrawn from the housing.

14. The combined assembly defined in claim 7 wherein the electrical contact includes a first contact portion and a second contact portion that are connected by an intermediate contact portion, and wherein each of the first contact portion and the second contact portion frictionally engage the housing.

* * * * *